US009429374B2

(12) United States Patent
Kojo et al.

(10) Patent No.: US 9,429,374 B2
(45) Date of Patent: Aug. 30, 2016

(54) RAIL COOLING METHOD

(75) Inventors: Rinya Kojo, Tokyo (JP); Hiroyuki Fukuda, Tokyo (JP); Yuta Tamura, Tokyo (JP); Yoshikazu Yoshida, Tokyo (JP); Hideki Takahashi, Tokyo (JP); Ryo Matsuoka, Tokyo (JP); Yuzuru Kataoka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/376,652

(22) PCT Filed: Feb. 6, 2012

(86) PCT No.: PCT/JP2012/052581

§ 371 (c)(1),
(2), (4) Date: Aug. 5, 2014

(87) PCT Pub. No.: WO2013/118235

PCT Pub. Date: Aug. 15, 2013

(65) Prior Publication Data

US 2014/0360715 A1 Dec. 11, 2014

(51) Int. Cl.

| | |
|---|---|
| ***C21B 7/24*** | (2006.01) |
| ***F28F 27/00*** | (2006.01) |
| ***C21D 9/04*** | (2006.01) |
| ***C21D 11/00*** | (2006.01) |
| ***C21D 1/62*** | (2006.01) |
| ***F27D 15/02*** | (2006.01) |

(52) U.S. Cl.

CPC ..... *F28F 27/00* (2013.01); *C21D 1/62* (2013.01); *C21D 9/04* (2013.01); *C21D 11/005* (2013.01); *F27D 15/0213* (2013.01)

(58) Field of Classification Search

CPC ..... C21B 7/24; C21D 9/04
USPC ..... 148/128, 143, 145
See application file for complete search history.

(56) References Cited

U.S. PATENT DOCUMENTS

| | | | |
|---|---|---|---|
| 4,611,789 | A | 9/1986 | Ackert et al. |
| 2004/0187974 | A1 | 9/2004 | Kuppers et al. |

FOREIGN PATENT DOCUMENTS

| | | | |
|---|---|---|---|
| CA | EP0098492 | A2 * | 6/1983 |
| JP | A-59-074227 | | 4/1984 |
| JP | A-61-060827 | | 3/1986 |
| JP | A-10-130730 | | 5/1998 |
| JP | A-2004-537649 | | 12/2004 |
| JP | A-2005-290486 | | 10/2005 |

OTHER PUBLICATIONS

Apr. 24, 2012 International Search Report issued in International Application No. PCT/JP2012/052581.

* cited by examiner

*Primary Examiner* — Jie Yang
(74) *Attorney, Agent, or Firm* — Oliff PLC

(57) ABSTRACT

A rail cooling method includes: calculating, based on a relation between temperatures and an amount of warp of the rail cooled to ambient temperature after the forced cooling, the temperatures including a cooling start temperature of the head, a cooling end temperature of the head, a cooling start temperature of the foot and a cooling end temperature of the foot, a target value or a target value range for each of the temperatures so that the amount of warp of the rail at ambient temperature falls within a permissive range; and setting a cooling condition in accordance with the target value or the target value range to perform the forced cooling on the head and the foot.

12 Claims, 4 Drawing Sheets

RAIL COOLING METHOD

FIELD

The present invention relates to a rail cooling method for performing forced cooling on a head and a foot of a hot-rolled rail.

BACKGROUND

Hot-rolled rails at a high temperature above the austenite transformation temperature range are, in some cases, subjected to forced cooling as heat treatment to ensure desired qualities such as hardness required for the rail head. In other words, the hot-rolled rails are cooled with a cooling medium sprayed onto the rails. Normally, the forced cooling. (hereinafter also referred to as heat treatment cooling) in a heat treatment process is performed until the microstructure of the rail head is completely transformed from austenite to pearlite or bainite, and the cooling stops when the temperature drops down to about 400° C. to 500° C. The heat treatment cooling on rails is normally performed on both head and foot of the rails in an upright position. The heat treatment cooling on the head is performed to ensure the qualities such as hardness as described above, whereas the heat treatment cooling on the foot is performed to prevent upward and downward warp of the rails caused by heat stress occurring due to a temperature difference between the head and the foot.

Various techniques are disclosed for obtaining rails with smaller warp while ensuring the qualities for the rail head. For example, Patent Literature 1 discloses a method for cooling a rail by which the rail head is cooled with a cooling medium sprayed thereon in an amount that satisfies a target for material quality, while the rail foot is cooled with a cooling medium sprayed thereon in an amount adjusted to straighten a curved shape of the rail. Patent Literature 2 discloses a method in which cooling on the foot starts before cooling on the head starts. Patent Literature 3 discloses a method in which cooling on the head and cooling on the foot are simultaneously started but the head is more strongly cooled than the foot to minimize the warp.

CITATION LIST

Patent Literature

Patent Literature 1: Japanese Patent Application Laid-open No. 61-060827

Patent Literature 2: Japanese Patent Application Laid-open No. 10-130730

Patent Literature 3: Japanese Patent Application Laid-open No. 2005-290486

SUMMARY

Technical Problem

The warp of a rail after hot rolling as described above occurs not only in the heat treatment cooling process but also in a period after the heat treatment cooling process until the rail is cooled to ambient temperature. The techniques disclosed in Patent Literatures 1 to 3, however, fail to consider the warp of a rail occurring after the heat treatment cooling process until the rail holds ambient temperature, and thus the rail cannot eventually be straightened in some cases when the rail is cooled to ambient temperature.

The present invention has been made in view of the problem described above, and it is an object of the present invention to provide a rail cooling method with which warp of a rail can surely be prevented when the rail is cooled to ambient temperature.

Solution to Problem

To solve the above-described problem and achieve the object, a rail cooling method according to the present invention performs forced cooling on a head and a foot of a hot-rolled rail and includes: calculating, based on a relation between temperatures and an amount of warp of the rail cooled to ambient temperature after the forced cooling, the temperatures including a cooling start temperature of the head when the forced cooling on the head is started, a cooling end temperature of the head when the forced cooling on the head is ended, a cooling start temperature of the foot when the forced cooling on the foot is started and a cooling end temperature of the foot when the forced cooling on the foot is ended, a target value or a target value range for each of the temperatures so that the amount of warp of the rail at the normal temperature falls within a permissive range; and setting a cooling condition in accordance with the target value or the target value range to perform the forced cooling on the head and the foot.

Advantageous Effects of Invention

The rail cooling method according to the present invention can surely prevent warp of a rail when the rail is cooled to ambient temperature.

DESCRIPTION OF EMBODIMENT

Figure 1:
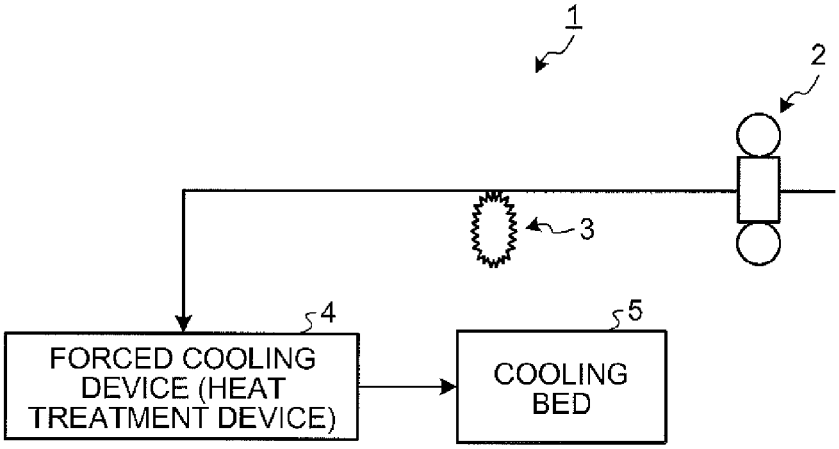
FIG. 1 is a diagram illustrating a main configuration of a rail production line.

The following describes an embodiment of the rail cooling method according to the present invention with reference to the accompanying drawings. The embodiment does not limit the scope of the present invention. The same reference signs are given to the same parts illustrated in the drawings.

Embodiment

FIG. 1 is a diagram illustrating a main configuration of a rail production line 1 to which the rail cooling method according to the present embodiment is applied. As illustrated in FIG. 1, the rail production line 1 includes a finishing mill 2, a hot saw 3, a forced cooling device 4 (hereinafter also referred to as a heat treatment device 4), and a cooling bed 5, and produces rails (railroad rails). In the rail production line 1, a rail after a preceding process is conveyed to the finishing mill 2 at which the rail is rolled to have a product cross sectional shape. The rail is then conveyed to the hot saw 3 at which crops of the front and back ends of the rail are cut off and the rail is cut to have a predetermined length. The resultant rail is conveyed to the heat treatment device 4. The heat treatment device 4 performs heat treatment (forced cooling: hereinafter also simply referred to as cooling) on a hot-rolled rail depending on desired qualities. After the heat treatment cooling in the heat treatment device 4, the rail is conveyed to the cooling bed 5 to be cooled to ambient temperature.

Figure 2:
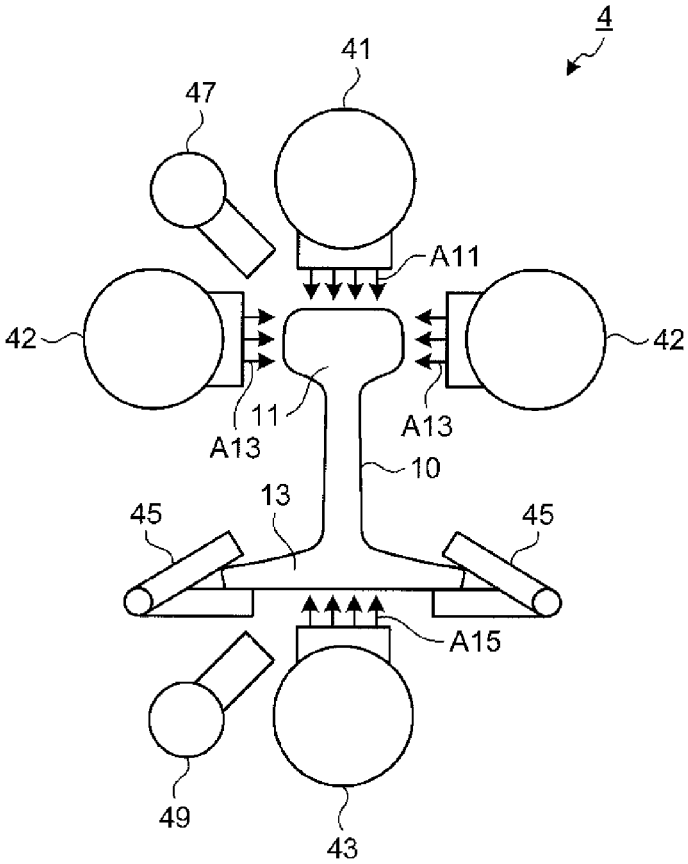
FIG. 2 is a schematic cross sectional view illustrating a configuration of a forced cooling device.
Figure 3:
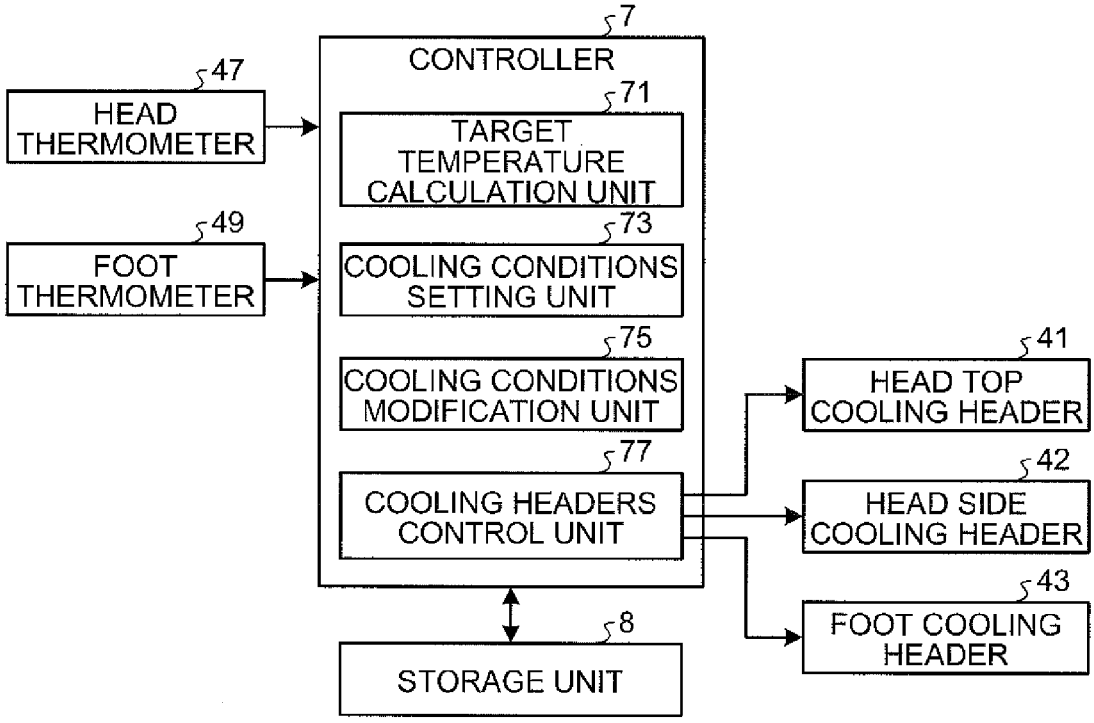
FIG. 3 is a block diagram illustrating a configuration example of a main control system of the forced cooling device.

FIG. 2 is a schematic sectional view illustrating a configuration of the heat treatment device 4. FIG. 3 is a block diagram illustrating a configuration example of a main control system of the heat treatment device 4. A rail 10 after hot rolling is conveyed in an upright position to a processing position in the heat treatment device 4, and the heat treatment device 4 cools a head 11 and a foot 13 of the rail 10.

As illustrated in FIG. 2, the heat treatment device 4 includes a head top cooling header 41 and head side cooling headers 42 for cooling the head 11 of the rail 10, and includes a foot cooling header 43 for cooling the foot 13 of the rail 10.

The head top cooling header 41, the head side cooling headers 42, and the foot cooling header 43 (hereinafter collectively referred to as cooling headers 41, 42, and 43 as appropriate) are connected to a source of a cooling medium via pipes, and spray the cooling medium such as air from a plurality of nozzles (not illustrated). Specifically, the head top cooling header 41 is disposed above the head 11 of the rail 10 in the processing position along the longitudinal direction of the rail 10, and cools the head 11 by spraying the cooling medium to the head top of the head 11 as indicated by arrows A11 in FIG. 2. The head side cooling headers 42 are disposed at both sides of the head 11 of the rail 10 in the processing position along the longitudinal direction of the rail 10, and cools the head 11 by spraying the cooling medium to both sides of the head 11 as indicated by arrows A13 in FIG. 2. The foot cooling header 43 is disposed below the foot 13 of the rail 10 in the processing position along the longitudinal direction of the rail 10, and cools the foot 13 by spraying the cooling medium to the bottom surface of the foot 13 as indicated by arrows A15 in FIG. 2.

The heat treatment device 4 includes a pair of clamps 45 disposed in positions opposite to each other at both sides of the foot 13 of the rail 10 conveyed to the processing position. The pair of clamps 45 are provided to prevent the rail 10 in the heat treatment cooling process from moving in the upward or downward direction of the rail 10 by holding both sides of the foot 13 of the rail 10 in the processing position, and, for example, a plurality of pairs of clamps 45 are disposed along the longitudinal direction of the rail 10 at appropriate positions at both sides of the foot 13 of the rail 10 in the processing position.

The heat treatment device 4 includes a head thermometer 47 disposed above the head 11 of the rail 10 for measuring the temperature of the head 11, more specifically, the temperature of a head edge (a gauge corner), and a foot thermometer 49 disposed below the foot 13 of the rail 10 for measuring the temperature of the foot 13. The head thermometer 47 and the foot thermometer 49 are connected to a controller 7 as illustrated in FIG. 3, and continuously output measured values to the controller V.

Figure 5:
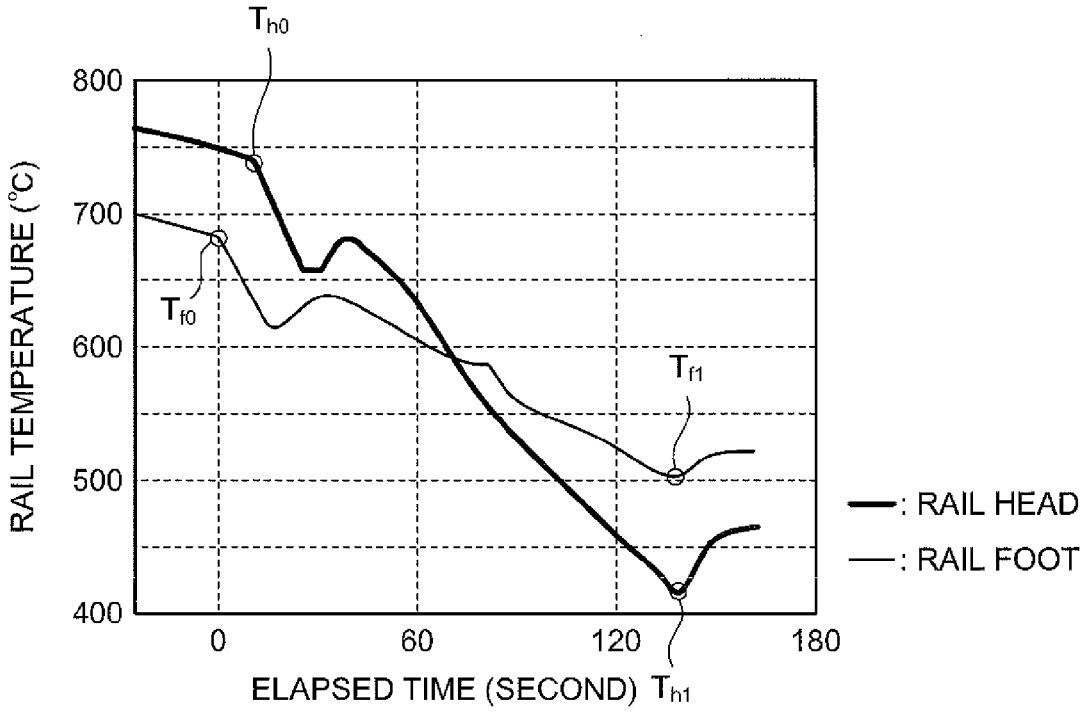
FIG. 5 is a diagram illustrating transition curves indicating temperatures of a rail in a forced cooling process.

The controller 7 monitors the temperatures of the head 11 and the foot 13 of the rail 10 in the heat treatment cooling process, and controls the cooling headers 41, 42, and 43 to spray the cooling medium so that a head cooling start temperature $T_{h0}$ and a head cooling end temperature $T_{h1}$ of the head 11, and a foot cooling start temperature $T_{f0}$ and a foot cooling end temperature $T_{f1}$ of the foot 13, which are illustrated in FIG. 5 to be described later, achieve respective target values.

The controller 7 is connected to a storage unit 8 that stores therein, for example, various computer programs and data necessary for monitoring the temperatures of the head 11 and the foot 13 of the rail 10 and for controlling the cooling headers 41, 42, and 43 to spray the cooling medium. The storage unit 8 accumulates and stores therein, for example, target values for the head cooling start temperature $T_{h0}$, the head cooling end temperature $T_{h1}$, the foot cooling start temperature $T_{f0}$, and the foot cooling end temperature $T_{f1}$, and actual values of the temperatures $T_{h0}$, $T_{h1}$, $T_{f0}$, and $T_{f1}$ obtained in previous operations. The storage unit 8 is implemented by a storage device such as various types of IC memories such as a flash memory or a RAM that are rewritable memories, hard disks, or various types of storage media. The controller 7 is also connected, as necessary, to an input device (not illustrated) that inputs, to the controller 7, information necessary for monitoring the temperatures and controlling the cooling headers 41, 42, and 43 to spray the cooling medium, and a display device (not illustrated) that displays on a monitor the temperatures of the head 11 and the foot 13 of the rail 10 in the heat treatment cooling process, for example.

As illustrated in FIG. 3, the controller 7 includes, as main functional units, a target temperature calculation unit 71, a cooling conditions setting unit 73, a cooling conditions modification unit 75, and a cooling headers control unit 77.

The target temperature calculation unit 71 calculates target values for the head cooling start temperature $T_{h0}$, the head cooling end temperature $T_{h1}$, the foot cooling start temperature $T_{f0}$, and the foot cooling end temperature $T_{f1}$. The cooling conditions setting unit 73 sets cooling conditions such as a cooling time for the respective cooling headers 41, 42, and 43, or air volume of the cooling medium (air) sprayed from the cooling headers 41, 42, and 43 based on the calculated target values for the temperatures $T_{h0}$, $T_{h1}$, $T_{f0}$, and $T_{f1}$. The cooling conditions modification unit 75 modifies the cooling conditions based on actual values of the temperatures $T_{h0}$, $T_{h1}$, $T_{f0}$, and $T_{f1}$ obtained in the cooling operation. The cooling headers control unit 77 controls the cooling headers 41, 42, and 43 to spray the cooling medium in accordance with the cooling conditions set by the cooling conditions setting unit 73 or modified by the cooling conditions modification unit 75.

Figure 4:
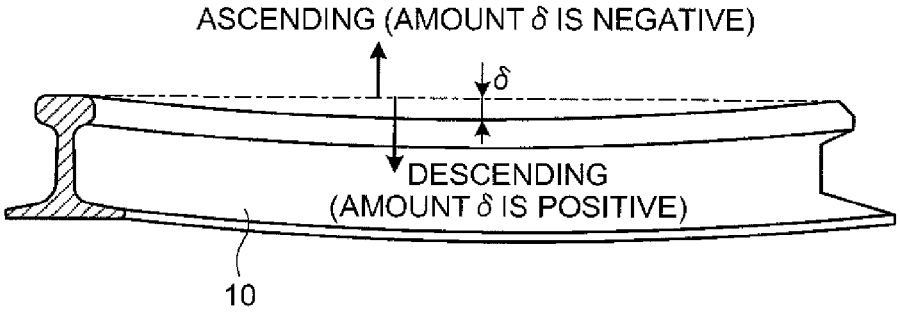
FIG. 4 is a diagram illustrating an amount of warp of a rail in a product length.

As described above, after the heat treatment cooling process in the heat treatment device 4, the hot-rolled rail 10 is cooled at the cooling bed 5 eventually to ambient temperature. In this cooling process, the rail 10 may be curved (warped) upward or downward. The warp of the rail 10 occurs not only in the heat treatment cooling process in the heat treatment device 4, but also in a time period during which the rail 10 is laid on the cooling bed 5, that is, during which the rail 10 is cooled from a temperature range immediately after the heat treatment cooling to ambient temperature. FIG. 4 is a diagram illustrating an amount δ of warp of the rail 10 in the product length. The amount δ of warp of the rail 10 is defined as the maximum ascending amount or the maximum descending amount of the head top surface of the rail 10 from a line connecting both ends of the head top surface of the rail 10 indicated by the alternate long and short dash line in FIG. 4, or the maximum ascending amount or the maximum descending amount of the bottom surface of the rail 10 from a line (not illustrated) connecting both ends of the bottom surface of the rail 10 in the present embodiment. The ascending amount is represented by a negative value, and the descending amount is represented by a positive value.

FIG. 5 is a diagram illustrating transition curves indicating surface temperatures (hereinafter simply referred to as temperatures) of the rail 10 in the heat treatment cooling process, and a temperature change of the head 11 is indicated by the bold line and a temperature change of the foot 13 is indicated by the thin line. In the example illustrated in FIG. 5, the foot cooling header 43 starts spraying the cooling medium first to cool the foot 13, and cooling start time for the head 11 comes 15 seconds after the cooling start time for the foot 13, when the head top cooling header 41 and the head side cooling headers 42 start spraying the cooling medium to cool the head 11. Cooling end time for the head 11 and the foot 13 comes 135 seconds after the cooling start time for the foot 13, when the cooling headers 41, 42, and 43 stop spraying the cooling medium to simultaneously end the cooling on the head 11 and the foot 13.

As illustrated in FIG. 5, the temperature of the head 11 of the rail 10 in the heat treatment cooling process decreases progressively from the head cooling start temperature $T_{h0}$ that is a temperature of the head 11 at the cooling start time (15 seconds) of the head 11. The temperature of the head 11 increases for a while due to transformation heat release, and decreases to the head cooling end temperature $T_{h1}$ that is a temperature of the head 11 at the head cooling end time (135 seconds). The temperature again increases for a while because of recuperation of heat, and then decreases to ambient temperature. The temperature of the foot 13 changes in the same manner. The temperature of the foot 13 of the rail 10 in the heat treatment cooling process decreases from the foot cooling start temperature $T_{f0}$ that is a temperature of the foot 13 at the cooling start time (0 second) of the foot 13 to the foot cooling end temperature $T_{f1}$ that is a temperature of the foot 13 at the cooling end time (135 seconds) of the foot 13, and decreases to ambient temperature.

The inventors of the present invention changed the cooling conditions and conducted heat treatment cooling. The inventors studied the amount δ of warp of the rail 10 cooled to ambient temperature, and found out a correlation between the head cooling start temperature $T_{h0}$, the head cooling end temperature $T_{h1}$, the foot cooling start temperature $T_{f0}$, and the foot cooling end temperature $T_{f1}$ of the rail 10 in the heat treatment cooling process and the amount δ of warp of the rail 10 at ambient temperature.

In other words, the inventors found out that the amount δ of warp at ambient temperature can be represented by an expression using the temperatures $T_{h0}$, $T_{h1}$, $T_{f0}$, and $T_{f1}$, specifically, represented by a regression formula represented by expression (1) obtained by regression calculations using the temperatures $T_{h0}$, $T_{h1}$, $T_{f0}$, and $T_{f1}$. The constant value of expression (1) is −1254. The coefficients and the constant value are illustrative and are calculated depending on conditions such as rail types. The inventors used a rail with a length of 25 m (136 pounds per yard) in this example. The form of the expression can be changed as appropriate.

$$\text{The amount } \delta \text{ of warp at ambient temperature} = -1.06T_{h0}+4.02T_{h1}+2.59T_{f0}-2.86T_{f1}+\text{constant} \quad (1)$$

Figure 6:
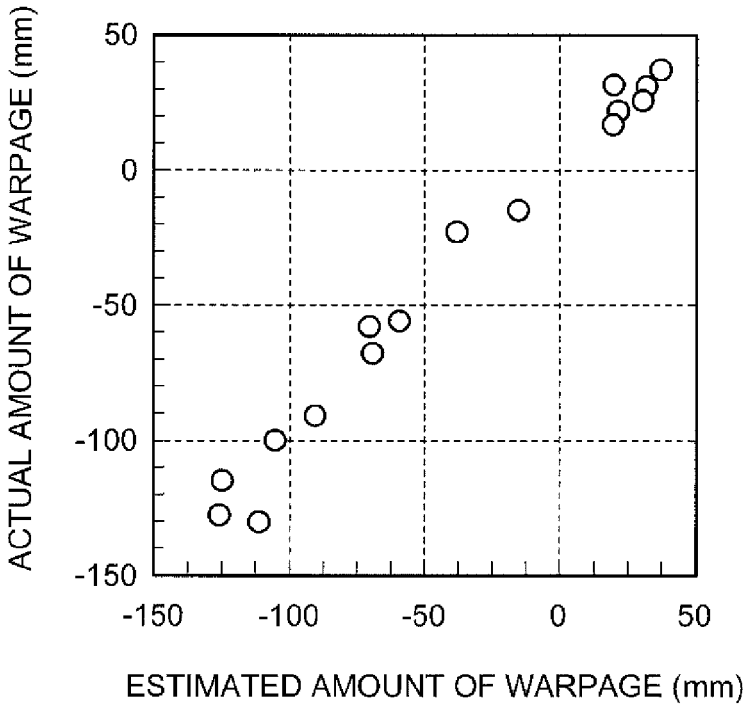
FIG. 6 is a diagram illustrating a relation between an actual amount of warp and an estimated amount of warp.

FIG. 6 is a diagram illustrating a relation between an actual amount δ (mm) of warp and an estimated amount δ (mm) of warp. The actual amount δ of warp is an amount δ of warp of the rail 10 obtained by measuring the warp that the rail 10 actually has when the rail 10 is cooled to ambient temperature. The estimated amount δ of warp is a regression value obtained by substituting actual values of the temperatures $T_{h0}$, $T_{h1}$, $T_{f0}$, and $T_{f1}$ in the heat treatment process for the corresponding temperatures in expression (1) above. FIG. 6 illustrates a high correlation between the actual amount δ and the estimated amount δ of warp.

In the present embodiment, target values for the ideal temperatures $T_{h0}$, $T_{h1}$, $T_{f0}$, and $T_{f1}$ are calculated with which the amount δ of warp at ambient temperature has a value of zero by using a relational expression such as expression (1), and cooling conditions are set and modified so that the temperatures $T_{h0}$, $T_{h1}$, $T_{f0}$, and $T_{f1}$ of the head 11 and the foot 13 in the heat treatment cooling process achieve the calculated target values to control spraying operation of the cooling medium. This prevents warp of the rail 10 that the rail 10 eventually has when cooled to ambient temperature.

Figure 7:
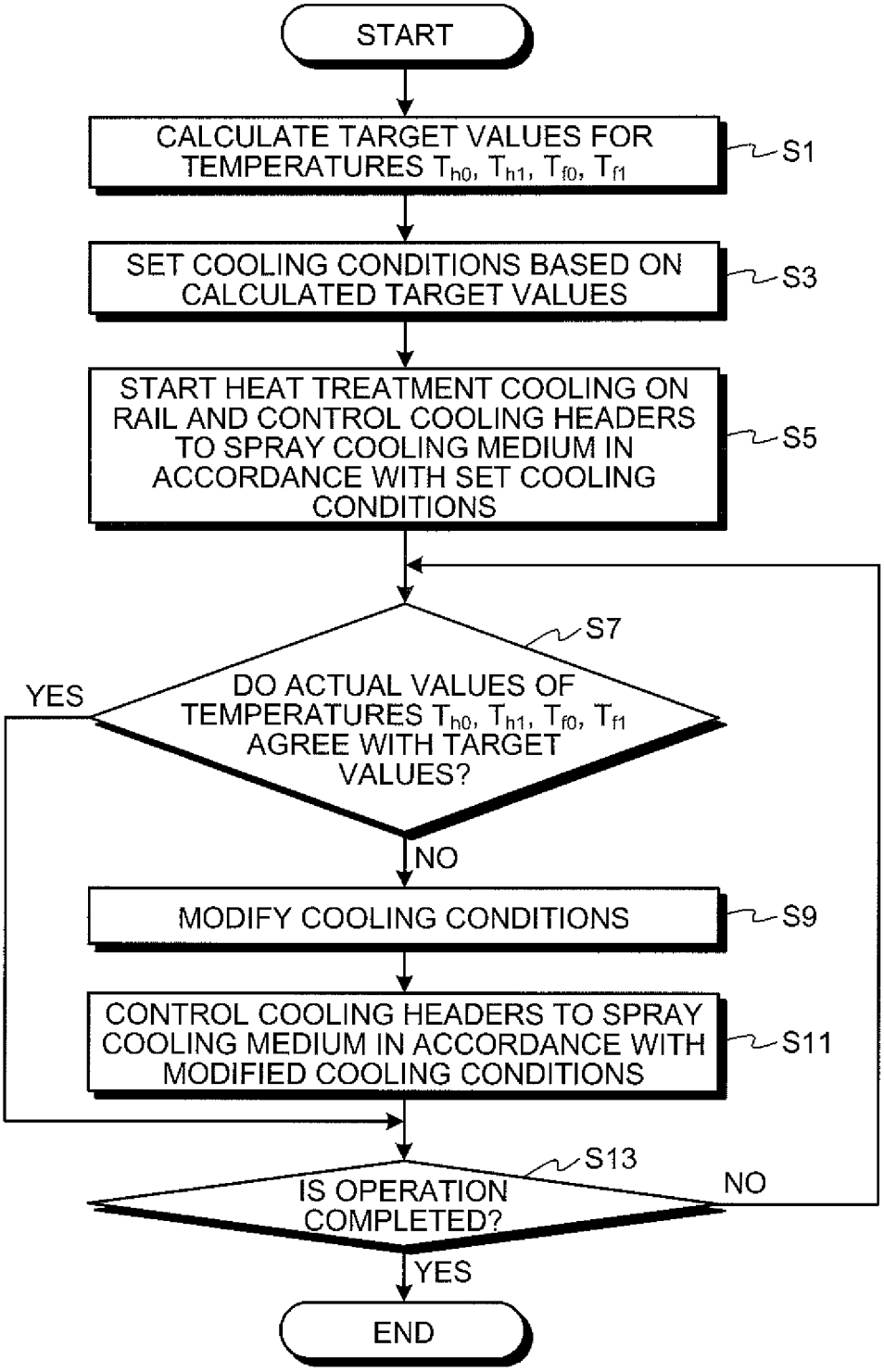
FIG. 7 is a flowchart illustrating a procedure of forced cooling.

FIG. 7 is a flowchart illustrating the procedure of heat treatment implemented by the heat treatment device 4. The heat treatment device 4 implements the rail cooling method by performing the processes illustrated in FIG. 7.

As illustrated in FIG. 7, the target temperature calculation unit 71 calculates target values for the head cooling start temperature $T_{h0}$, the head cooling end temperature $T_{h1}$, the foot cooling start temperature $T_{f0}$, and the foot cooling end temperature $T_{f1}$ (Step S1). Specifically, the target temperature calculation unit 71 calculates target values for the temperatures $T_{h0}$, $T_{h1}$, $T_{f0}$, and $T_{f1}$ by referring to a relational expression such as expression (1) above so that the amount δ of warp at ambient temperature has a value of zero.

In calculating the target values for the temperatures $T_{h0}$, $T_{h1}$, $T_{f0}$, and $T_{f1}$, the following constraints are set in advance.

The target values for the head cooling start temperature $T_{h0}$ and the foot cooling start temperature $T_{f0}$ need to be feasible values so that the rail can achieve the target temperatures when processed by the heat treatment device 4 in an actual production line. Setting a high temperature that has never been taken in the previous operations, for example, is impractical. Thus, upper limits of the temperatures $T_{h0}$ and $T_{f0}$ are set in advance based on the results of the previous operations. The target value for the head cooling start temperature $T_{h0}$ is set to a value equal to or higher than a lower-limit temperature at which hardness required for the rail head can be given. Specifically, the target value for the head cooling start temperature $T_{h0}$ needs to be a temperature at which the head is transformed into the austenite phase.

The target value for the head cooling end temperature $T_{h1}$ must be set to a temperature at which transformation of the head 11 can be completed so that the qualities such as hardness required for the head 11 are ensured. Thus, an upper limit is set on the target value of the head cooling end temperature $T_{h1}$ in terms of completing the transformation. Setting an extremely low value for the target values for the head cooling end temperature $T_{h1}$ and the foot cooling end temperature $T_{f1}$ requires a longer processing time than necessary in the forced cooling device (heat treatment device). Thus, it is preferable to set a lower limit on the target values for the temperatures $T_{h1}$ and $T_{f1}$.

Values of the temperatures $T_{h0}$, $T_{h1}$, $T_{f0}$, and $T_{f1}$ are calculated that satisfy the above described constraints and with which δ=0 is obtained from a relational expression such as expression (1), and the values are set to be the target values.

Heat treatment cooling on the head 11 of the rail 10 continues until the rail 10 is completely transformed in order to ensure the qualities such as hardness required for the head 11. This determines a temperature range and cooling time (rate of cooling) for the head 11 in the heat treatment cooling process required for ensuring target qualities. Heat treatment cooling on the foot 13 is performed to prevent warp of the rail 10 caused by heat stress occurring due to a temperature difference between the head 11 and the foot 13. Thus, cooling conditions for the foot 13 can be adjusted to some extent as long as the warp is suppressed within a permitted range. In the present embodiment, the target temperature calculation unit 71 calculates target values for the temperatures $T_{h0}$, $T_{h1}$, $T_{f0}$, and $T_{f1}$ by adjusting values of the foot cooling start temperature $T_{f0}$ and the foot cooling end temperature $T_{f1}$ so that the amount δ of warp at ambient temperature comes near zero as much as possible. The permitted range of warp can be determined depending on the manufacturing procedure or applications of the rail. Examples of the permitted range include tolerances on warp permitted for a product. When the production procedure includes a roller straightening process on the rail in the production line after the heat treatment cooling process, the permitted range may be determined with consideration of the straightening effect on warp in the roller straightening process.

The cooling conditions setting unit 73 sets cooling conditions based on the target values for the temperatures $T_{h0}$, $T_{h1}$, $T_{f0}$, and $T_{f1}$ calculated at Step S1 (Step S3). In this process, the cooling conditions for the head 11 need to be set such that the temperature range and cooling time for the head 11 in the heat treatment cooling process are feasible for the same reason as in Step S1. The cooling conditions setting unit 73 in the present embodiment sets cooling conditions for the foot 13, specifically, sets cooling start time and end time of the foot cooling header 43 and/or the air volume of the cooling medium sprayed by the foot cooling header 43 to be the cooling conditions.

When setting the cooling start time and end time, for example, the cooling conditions setting unit 73 sets them so that the foot cooling start temperature $T_{f0}$ and the foot cooling end temperature $T_{f1}$ achieve target values along with heat treatment cooling on the head 11 based on the results of the previous operations, for example. The air volume of the cooling medium can also be set based on the results of the previous operations. The cooling conditions setting unit 73 may set the air volume of the cooling medium so that the temperatures $T_{f0}$ and $T_{f1}$ achieve the target values. In the processing at Step S3, the cooling conditions setting unit 73 is simply required to set the cooling conditions such that the actual values of the temperatures $T_{h0}$, $T_{h1}$, $T_{f0}$, and $T_{f1}$ in the heat treatment cooling process achieve the target values for the temperatures $T_{h0}$, $T_{h1}$, $T_{f0}$, and $T_{f1}$ calculated at Step S1. Thus, the cooling conditions setting unit 73 may set the cooling conditions by adjusting both cooling start time and end time and air volume of the cooling medium.

After Step S3, the heat treatment device 4 starts heat treatment cooling on the rail 10, and the cooling headers control unit 77 controls the cooling headers 41, 42, and 43 to spray the cooling medium in accordance with the set cooling conditions (Step S5). After the heat treatment process is started as described above, the controller 7 monitors the temperatures of the head 11 and the foot 13 continuously input from the head thermometer 47 and the foot thermometer 49. If the actual values of the temperatures $T_{h0}$, $T_{h1}$, $T_{f0}$, and $T_{f1}$ agree with the target values set at Step S1 (Yes at Step S7), the heat treatment device 4 repeats the heat treatment cooling process on rails 10 sequentially conveyed from the finishing mill 2 as processing subjects.

If the actual values of the temperatures $T_{h0}$, $T_{h1}$, $T_{f0}$, and $T_{f1}$ fail to agree with the target values (No at Step S7), the cooling conditions modification unit 75 modifies the cooling conditions (Step S9). The present embodiment mainly assumes a case in which the foot cooling start temperature $T_{f0}$ and the foot cooling end temperature $T_{f1}$ fail to agree with the target values. Specifically, when the temperatures $T_{f0}$ and $T_{f1}$ are determined not to agree with the target values, the cooling conditions modification unit 75 obtains a temperature difference between the actual value and the target value, and modifies the cooling conditions for the foot 13 in accordance with the obtained temperature difference. In a case of modifying the cooling start time, for example, when the actual value of the foot cooling start temperature $T_{f0}$ is lower than the target value, the cooling conditions modification unit 75 changes the cooling start time to an earlier time so that the actual value agrees with the target value. More specifically, when the actual value of the foot cooling start temperature $T_{f0}$ illustrated in FIG. 5 is lower than the target value, the cooling conditions modification unit 75 modifies the cooling start time (zero second) that is currently set for the foot 13 such that the cooling start time is changed to an earlier time by a time period in accordance with the temperature difference between the target value and the actual value. The time period in accordance with the temperature difference may be determined based on the results of the previous operations, for example.

The description above is illustrative and not limiting. The cooling conditions may be modified by recalculating the target values for the temperatures $T_{h0}$, $T_{h1}$, $T_{f0}$, and $T_{f1}$ using expression (1) above so that the amount δ of warp at ambient temperature has a value of zero, and by newly setting the cooling conditions based on the recalculated target values in the same manner as in Step S3.

The cooling headers control unit 77 controls the cooling headers 41, 42, and 43 to spray the cooling medium in accordance with the modified cooling conditions in the subsequent heat treatment cooling process (Step S11). As long as the operation continues (No at Step S13), the process returns to Step S7 and the above described processes are repeated.

EXAMPLES

The inventors conducted heat treatment cooling in accordance with the procedure illustrated in FIG. 7 and studied the amount δ of warp at ambient temperature. The inventors used a rail having a length of 25 m (136 pounds per yard). The rail normally has a temperature of about 900° C. immediately after hot rolling in the finishing mill 2, and the head cooling start temperature $T_{h0}$ is about 720° C. and the head cooling end temperature $T_{h1}$ is about 420° C. Accordingly, the inventors set the target value for the head cooling start temperature $T_{h0}$ to 720° C. and the target value for the head cooling end temperature $T_{h1}$ to 420° C. The inventors calculated the target values for the foot cooling start temperature $T_{f0}$ and the foot cooling end temperature $T_{f1}$ by using expression (1) above, and obtained the temperature $T_{f0}$ of 680° C. and the temperature $T_{f1}$ of 500° C. The inventors then started heat treatment cooling and monitored the temperatures of the head and the foot to find out that the actual value of the foot cooling start temperature $T_{f0}$ was 660° C., which is lower than the target value. The actual values of the head cooling start temperature $T_{h0}$ and the head cooling end temperature $T_{h1}$ substantially agreed with the target values.

The inventors conducted a first example in which the cooling start time for the foot 13 was changed to an earlier time by 10 seconds so that the foot cooling start temperature $T_{f0}$ would achieve the target value of 680° C. The foot cooling header 43 was controlled to spray the cooling medium, accordingly.

The inventors conducted a second example in which the target value for the foot cooling start temperature Tf0 was change to the actual value of 660° C., and the target value for the foot cooling end temperature Tf1 was recalculated in accordance with expression (1) above so that the amount δ of warp had a value of zero. The newly obtained target value for the foot cooling end temperature Tf1 was 482° C. The inventors increased the air volume of the cooling medium from the foot cooling header 43 in accordance with the temperature difference between the newly obtained target value of 482° C. and the old target value of 500° C. so that the foot cooling end temperature Tf1 would have the new target value of 482° C. The foot cooling header 43 was controlled to spray the cooling medium, accordingly.

The inventors also conducted a comparative example in which heat treatment cooling was continued without modifying the cooling conditions. The inventors repeated the heat treatment cooling process for 10 pieces of rails in each example, and measured the amount δ of warp of each rail cooled to ambient temperature.

The results were that amounts δ of warp measured at ambient temperature in the first and the second examples fell within ±15 mm. The permitted range of the amount δ of warp is within ±20 mm for the rail of this type. Thus, the results obtained in the first and the second examples were good because the amounts δ of warp fell within the permitted range. In the comparative example, however, downward warp (50 to 70 mm) was measured in the rails and the amounts δ of warp at ambient temperature were outside the permitted range. Press straightening processing is required for the rails with the amounts δ of warp being outside the permitted range at ambient temperature to straighten the warp of the rails.

According to the present embodiment described above, target values for the ideal temperatures $T_{h0}$, $T_{h1}$, $T_{f0}$, and $T_{f1}$ can be calculated with which the amount δ of warp has a value of zero at ambient temperature in accordance with a relation, such as expression (1), between the predetermined temperatures (i.e., the head cooling start temperature $T_{h0}$, the head cooling end temperature $T_{h1}$, the foot cooling start temperature $T_{f0}$, and the foot cooling end temperature $T_{f1}$) of the rail 10 in the heat treatment cooling process and the amount δ of warp of the rail 10 at ambient temperature. The head and the foot of the rail can be cooled by setting cooling conditions so that the temperatures $T_{h0}$, $T_{h1}$, $T_{f0}$, and $T_{f1}$ of the head 11 and the foot 13 in the heat treatment cooling process achieve the calculated target values. When the actual values of the temperatures $T_{h0}$, $T_{h1}$, $T_{f0}$, and $T_{f1}$ deviate from the target values in the operation, the cooling conditions can be modified so that the temperatures $T_{h0}$, $T_{h1}$, $T_{f0}$, and $T_{f1}$ achieve the target values. This can surely reduce the warp that the rail eventually has when the rail is cooled to ambient temperature. This eliminates the need of press straightening process for straightening warp of the rail, thereby improving productivity.

Although target values for the head cooling start temperature $T_{h0}$, the head cooling end temperature $T_{h1}$, the foot cooling start temperature $T_{f0}$, and the foot cooling end temperature $T_{f1}$ are calculated in the embodiment described above, cooling conditions may be modified such that target value ranges for the temperatures $T_{h0}$, $T_{h1}$, $T_{f0}$, and $T_{f1}$ are calculated and the actual values thereof fall within the target value ranges.

Although, in the embodiment described above, cooling conditions for the foot 13 is set and modified, cooling conditions for the head 11 may also be set and modified. When, for example, the target values for the head cooling start temperature $T_{h0}$ and the head cooling end temperature $T_{h1}$ have a certain range, the target values for the head cooling start temperature $T_{h0}$ and the head cooling end temperature $T_{h1}$ may be changed as appropriate so that the temperatures fall within the range (target value range). The cooling conditions for, the head 11, that is, the cooling start time and end time of the head top cooling header 41 and the head side cooling headers 42, or the air volume of the cooling medium sprayed by the head top cooling header 41 and the head side cooling headers 42 may be set or modified, accordingly.

REFERENCE SIGNS LIST

4 Forced cooling device (Heat treatment device)
41 Head top cooling header
42 Head side cooling header
43 Foot cooling header
45 Clamp
47 Head thermometer
49 Foot thermometer
7 Controller
71 Target temperature calculation unit
73 Cooling conditions setting unit
75 Cooling conditions modification unit
77 Cooling headers control unit
8 Storage unit
$T_{h0}$ Head cooling start temperature
$T_{h1}$ Head cooling end temperature
$T_{f0}$ Foot cooling start temperature
$T_{f1}$ Foot cooling end temperature
δ Amount of warp

The invention claimed is:

1. A rail cooling method for performing forced cooling on a head and a foot of a hot-rolled rail, the rail cooling method comprising:

calculating an estimated amount of warp at an ambient temperature, based on a formula, that is a regression value obtained by regression calculations using temperatures including (1) a head cooling start temperature $T_{h0}$, (2) a head cooling end temperature $T_{h1}$, (3) a foot cooling start temperature $T_{f0}$, and (4) a foot cooling end temperature $T_{f1}$, wherein the formula is expressed as: the estimated amount of warp at the ambient temperature$=-1.06T_{h0}+4.02T_{h1}+2.59T_{f0}-2.86T_{f1}+$constant;

measuring an actual amount of warp of the rail that is a warp that the rail actually has when the rail is cooled to the ambient temperature after a forced cooling;

calculating, based on a relation between the actual amount of warp and the estimated amount of warp at the ambient temperature, a target value or a target value range for each of the temperatures $T_{h0}$, $T_{h1}$, $T_{f0}$, $T_{f1}$ such that an amount of warp of the rail at a normal temperature falls within a permissive range; and setting a cooling condition in accordance with the target value or the target value range to perform the forced cooling on the head and the foot.

2. The rail cooling method according to claim 1, further comprising:

obtaining an actual value of each of the temperatures in a cooling process on the head and the foot; and modifying, when the actual value differs from the target value or is outside the target value range, the cooling condition so that each of the temperatures agrees with the target value or falls within the target value range to perform the forced cooling on the head and the foot.

3. The rail cooling method according to claim 2, further comprising: recalculating, when the obtained actual value differs from the target value or is outside the target value range, a target value or a target value range for at least one of the temperatures based on the relation between the actual amount of warp and the estimated amount of warp, to modify the cooling condition such that each of the temperatures agrees with the recalculated target value or falls within the recalculated target value range.

4. The rail cooling method according to claim 3, wherein the relation between the actual amount of warp and the estimated amount of warp is represented by a linear expression.

5. The rail cooling method according to claim 4, wherein the forced cooling on the head and the foot is performed with a predetermined cooling medium; and the cooling condition is at least a cooling time to cool the foot and/or an amount of the cooling medium used to cool the foot.

6. The rail cooling method according to claim 3, wherein the forced cooling on the head and the foot is performed with a predetermined cooling medium; and the cooling condition is at least a cooling time to cool the foot and/or an amount of the cooling medium used to cool the foot.

7. The rail cooling method according to claim 2, wherein the relation between the actual amount of warp and the estimated amount of warp is represented by a linear expression.

8. The rail cooling method according to claim 7, wherein the forced cooling on the head and the foot is performed with a predetermined cooling medium; and the cooling condition is at least a cooling time to cool the foot and/or an amount of the cooling medium used to cool the foot.

9. The rail cooling method according to claim 2, wherein the forced cooling on the head and the foot is performed with a predetermined cooling medium; and the cooling condition is at least a cooling time to cool the foot and/or an amount of the cooling medium used to cool the foot.

10. The rail cooling method according to claim 1, wherein the relation between the actual amount of warp and the estimated amount of warp is represented by a linear expression.

11. The rail cooling method according to claim 10, wherein the forced cooling on the head and the foot is performed with a predetermined cooling medium; and the cooling condition is at least a cooling time to cool the foot and/or an amount of the cooling medium used to cool the foot.

12. The rail cooling method according to claim 1, wherein the forced cooling on the head and the foot is performed with a predetermined cooling medium; and the cooling condition is at least a cooling time to cool the foot and/or an amount of the cooling medium used to cool the foot.

* * * * *